United States Patent [19]

Soshi et al.

[11] Patent Number: 4,951,600

[45] Date of Patent: Aug. 28, 1990

[54] PAINTING MACHINE AND CONTROL UNIT FOR USE IN A PAINTING BOOTH

[75] Inventors: Fujio Soshi; Masaharu Okuda; Koichiro Asami, all of Tokyo, Japan

[73] Assignee: Taikisha, Ltd., Tokyo, Japan

[21] Appl. No.: 368,774

[22] Filed: Jun. 20, 1989

[30] Foreign Application Priority Data

Jun. 25, 1988 [JP] Japan ..... 63-157717

[51] Int. Cl.[5] ..... B05B 15/12

[52] U.S. Cl. ..... 118/696; 55/DIG. 46; 98/115.2; 118/323; 118/326; 118/DIG. 7; 901/43

[58] Field of Search ..... 118/663, 695, 696, 697, 118/323, 326, DIG. 7; 425/88; 52/33, 234; 901/43; 55/DIG. 46; 98/115.2

[56] References Cited

U.S. PATENT DOCUMENTS 4,278,046 7/1981 Clarke et al. ..... 118/697
4,630,567 12/1986 Bambousek et al. ..... 118/326
4,660,464 4/1987 Tanaka ..... 118/326
4,685,385 8/1987 Rich ..... 98/115.2

FOREIGN PATENT DOCUMENTS 3636199 4/1988 Fed. Rep. of Germany ..... 98/115.2
87/00771 2/1987 PCT Int'l Appl. ..... 98/115.2

*Primary Examiner*—James C. Housel
*Attorney, Agent, or Firm*—Webb, Burden, Ziesenheim & Webb

[57] ABSTRACT

A painting machine unit including a painting booth having a side wall with a substantially vertical wall portion insertable in an opening in the booth side wall and having a viewing window therethrough. The unit also includes a painting machine attached to an inner side of the wall portion and has a device for automatic painting of objects within the booth, and a control unit for controlling the device for automatic painting of objects within the booth. The control unit attaches to an outer side of the wall portion and is surrounded by a control chamber housing for accommodating painting booth operator.

12 Claims, 7 Drawing Sheets

PAINTING MACHINE AND CONTROL UNIT FOR USE IN A PAINTING BOOTH

BACKGROUND OF THE INVENTION

1. Field of the Invention

The present invention relates to a method of installing painting sytem and a painting-machine control unit for use in a painting booth.

2. Description of the Related Arts

First, before describing the invention, terms employed in this specification will be specifically defined.

A control unit C is defined herein as one or a combination of an operation control panel, electric control panel, air-pressure control panel, an electrostatic painting high-voltage generator and so on.

An external device is defined herein as one or combination of a power source, a paint feed device, a compressed air feed device and so on.

A first operation coupler is defined herein as one or combined plurality of a paint transport pipe, an electric cable, a compressed air pipe, an optical fiber and so on for communicating objects or data between the control unit C or the external device and a painting machine 13.

Further, when the control unit C consists of a combination of a plurality of the above-listed devices, a second-operation coupler is defined herein as one or combination of a paint transport pipe, an electric cable, a compressed air pipe, an optical fiber and so on for communicating objects or data between a sub-unit relating to the operation control panel, a sub-unit relating to the electric control panel, a sub-unit relating to the air-pressure control panel and a sub-unit relating to the electrostatic painting high-voltage generator.

Conventionally, as illustrated in FIG. 9 which shows a prior art method, after completion of a painting booth 1 at the painting factory, a painting machine 13 which has been assembled at another factory is introduced and installed on the floor of the painting booth 1, and also a control unit C for controlling the painting machine 13 is installed externally of the booth 1. After the initial installments, the following operations are carried out through a side wall of the painting booth 1 for operatively connecting the painting machine 13 and the control unit C opposed to each other across the booth side wall.

(I) connecting via various control valves varied and many pipes such as color paint transport pipes of various colors from the externally installed device through the side wall of the painting booth to the painting machine inside the booth;

(II) connecting compressed pressure air pipes for opening/closing the valves and couplers for communicating various control signals respectively to the painting machine between the control unit C and the painting machine 13 through the side wall;

Moreover, the following checking and/or adjusting operations are carried out to check the proper connections and installments.

(III) checking the proper connection between the painting machine 13 and the control unit C;

(VI) checking whether the various paint transport pipes have been properly connected with the respective pipe-connecting positions of the painting machine through the side wall of the booth 1.

(V) checking whether the control unit C disposed externally of the booth 1 can properly operate the painting machine 13 and the control valves.

With the above-specified prior installing method; however, after the initial installments of the painting machine and the control unit, the operations (I) and (II) for the connections and installations through the side wall take a great amount of time. Further, the checking-/adjusting operations (III) through (V) are also time-consuming and troublesome. Namely, the cables and pipes relating to the control unit C are great in number and complicated, thereby making the above operations further difficult. Accordingly, it is not rare that the system becomes ready for painting operation only after no less than one or two months counted from the date of the initial installments of the painting machine 13 and the control unit C.

In view of the above problem, the primary object of the present invention is to provide an improved method of installing a painting system at a painting booth which method can significantly reduce the time required for the system to become ready for actual painting operation after its initial installment at the booth.

A second object of the present invention is to provide an improved painting apparatus which permits easy and quick pre-operation testing procedures.

SUMMARY OF THE INVENTION

In order to accomplish the above-described primary object, a method of the invention for installing a painting system in a painting booth comprises the steps of:

(a) manufacturing a wall portion to be used in a side wall of the painting booth disposed adjacent a painting machine in the painting booth, the manufacturing step being effected separately from the manufacturing step of the side wall;

(b) attaching a control unit for controlling the painting machine to one side of the wall portion corresponding to an outer face of the painting booth and assembling a painting-machine control unit including the control unit and the wall portion;

(c) attaching the painting machine to another side of the wall portion opposed to the side attached with the control unit;

(d) operatively connecting the control unit with the painting machine by means of a first operation coupler and effecting test operations of the control unit, the first operation coupler and the painting machine; and (e) after effecting the steps (a) through (d) at a site different from a painting booth installment site, shipping at least the painting-machine control unit connected with or disconnected from the first operation coupler to said site and assembling the same with a portion of the side wall of the painting booth.

With the first characterizing feature of the invention, at step (e), the painting-machine control unit pre-connected at least with the control unit is shipped and then assembled with the painting booth. Accordingly, the assembly and connection operations including those of the control unit C may be carried out speedily at the painting factory. Then, the control unit is connected also with the first operation coupler when the unit is shipped at step (e), the connecting operations of the first operation coupler which includes various pipes and the like need not be carried out at the painting factory. Also, even if the control unit is shipped without being pre-connected with the first operation coupler, since the checking operations of proper connections are already carried out at the manufacturing factory, connecting and wire-extending operations between the painting machine and the control unit may be carried out without errors and speedily.

Further, as at the step (d) the test operations are carried out with complete connections before the shipment, the time required for adjustments and checks effected at a test run after pipe and cable extending operations may be significantly reduced or even eliminated at all.

Further, according to a second characterizing feature of the present invention, preferably, in said painting-machine control unit shipped at the step (e), said painting machine is attached further to said wall portion.

With this second feature, the installment operations at the painting site of the painting machine and the control unit may be further facilitated since the same are completed with only attaching the painting-machine control unit including the same to the side wall of the painting booth. With such further reduced time for installing the unit, other subsequent installment operations of the air conditioning device and the conveyor line of the painting booth will be carried out smoothly.

According to a third characterizing feature of the invention, at the shipping step (e), all or a part of the painting machine is kept disconnected from the control unit.

With this third feature, it becomes possible to reduce the total weight and volume of the painting-machine control unit to be shipped and also effectively to protect the driving unit of the painting machine from damages during the shipment, thereby furher facilitating the speedy shipment of the painting-machine control unit.

The foregoing and other objects, features and advantages of the invention will be apparent from the following more particular description of preferred embodiments of the invention, as illustrated in the accompanying drawings.

BRIEF DESCRIPTION OF THE DRAWINGS

Accompanying drawings FIGS. 1 through 4 illustrate one preferred embodiment of the present invention; in which, FIG. 1 is a section view, FIG. 2 is a perspective view, FIG. 3 is a side view, and FIG. 4 is a plane view.

DESCRIPTION OF THE PREFERRED EMBODIMENTS

Figure 1:
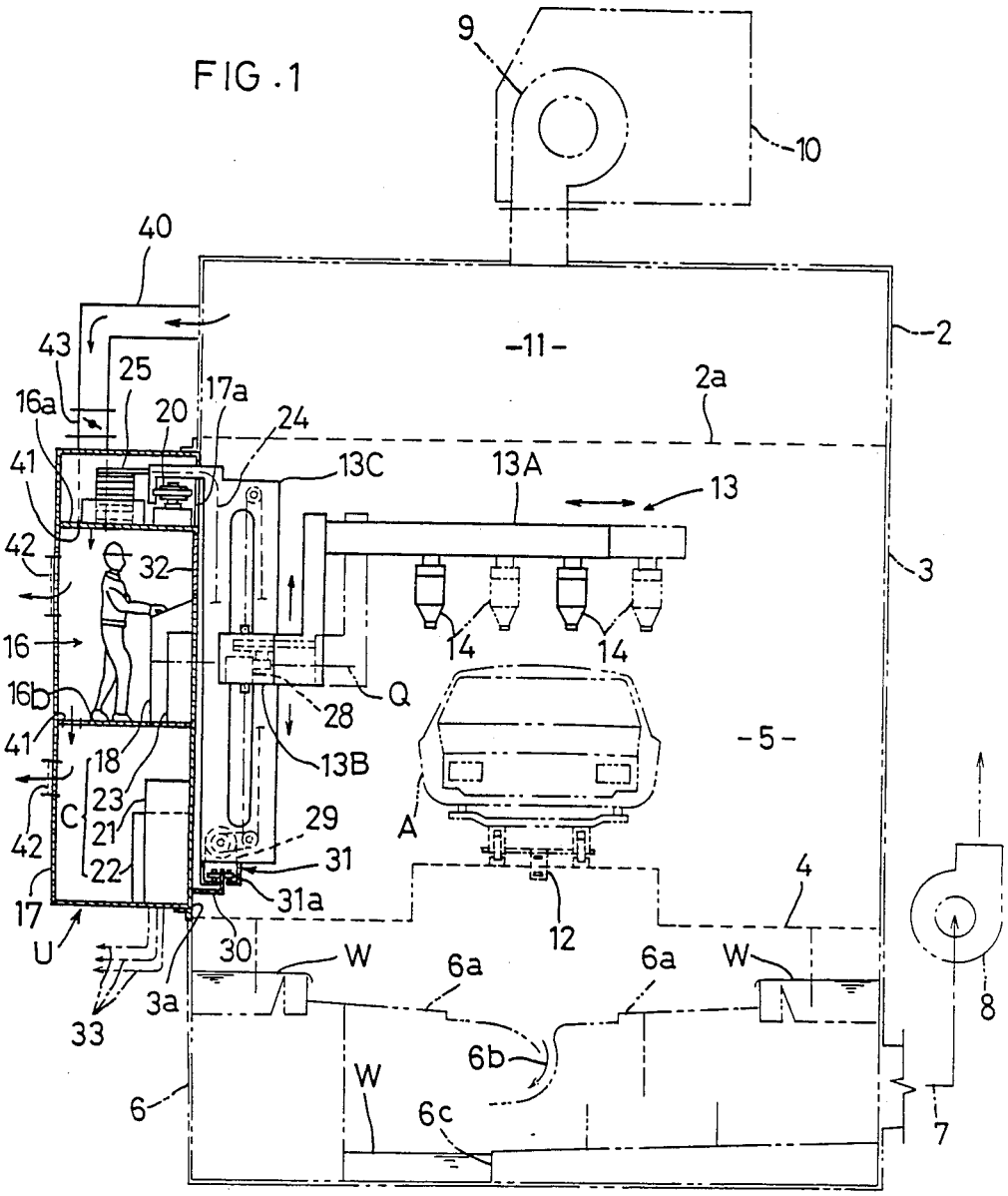
Figure 2:
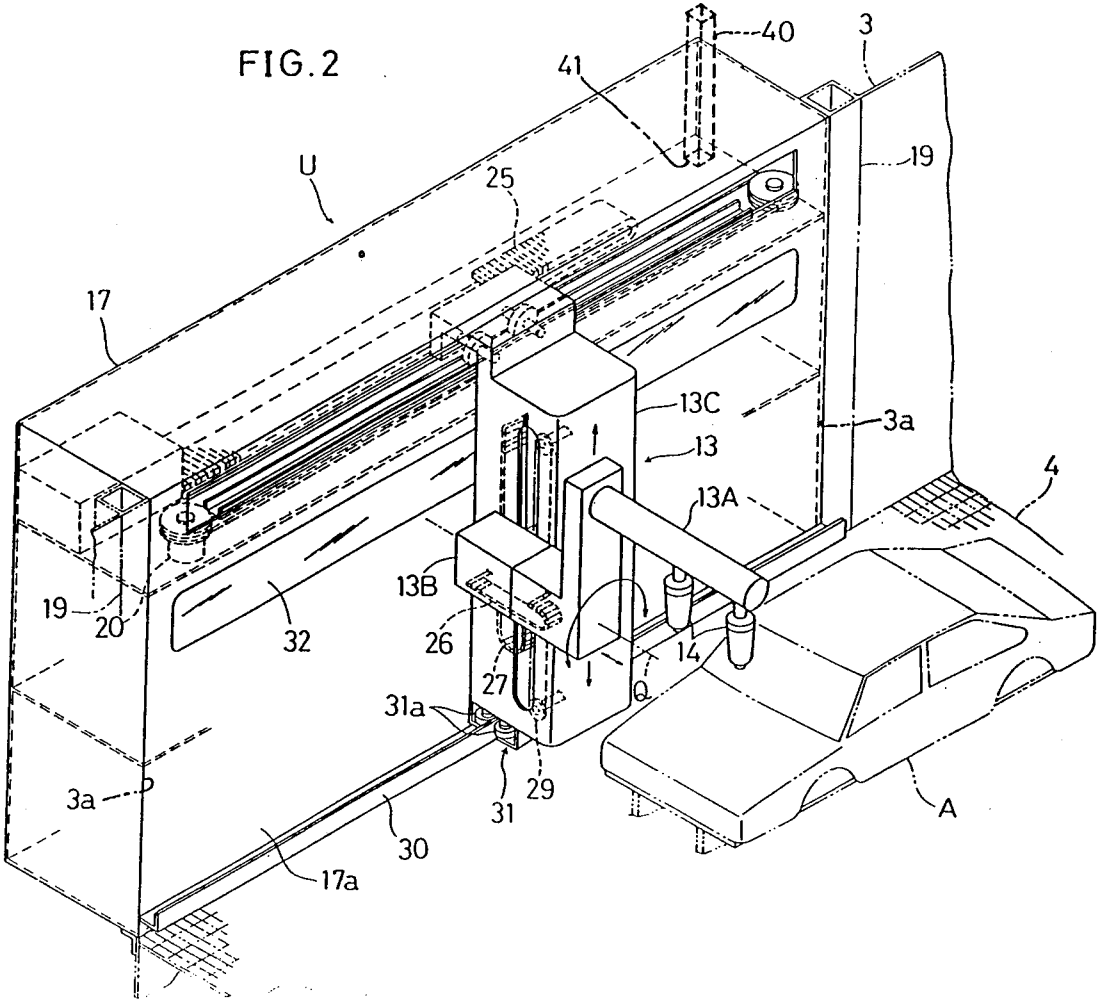
Figure 3:
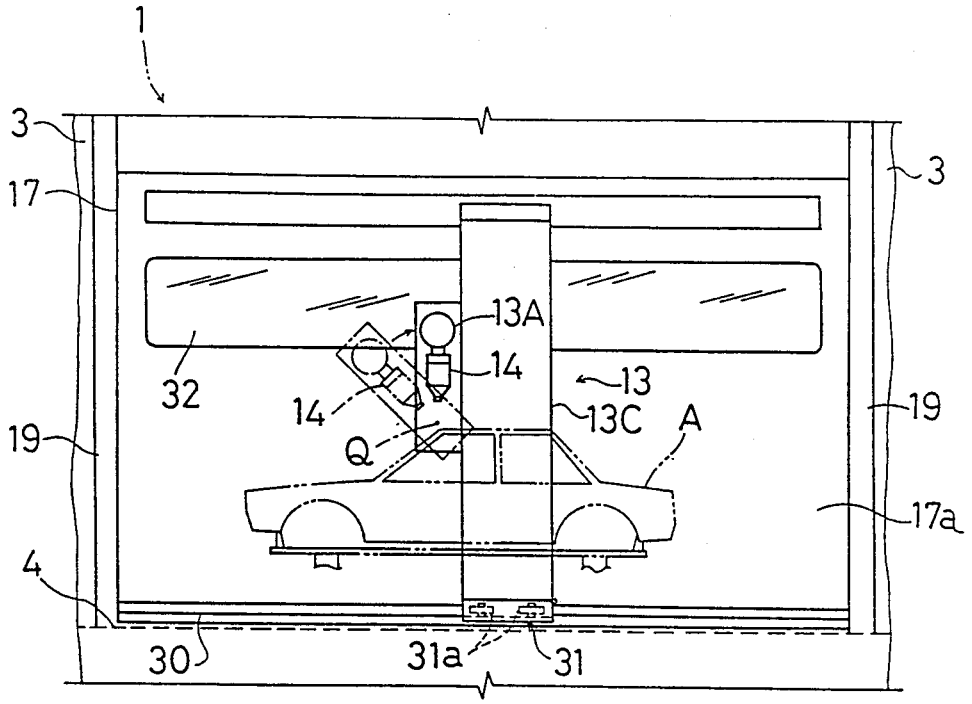
Figure 4:
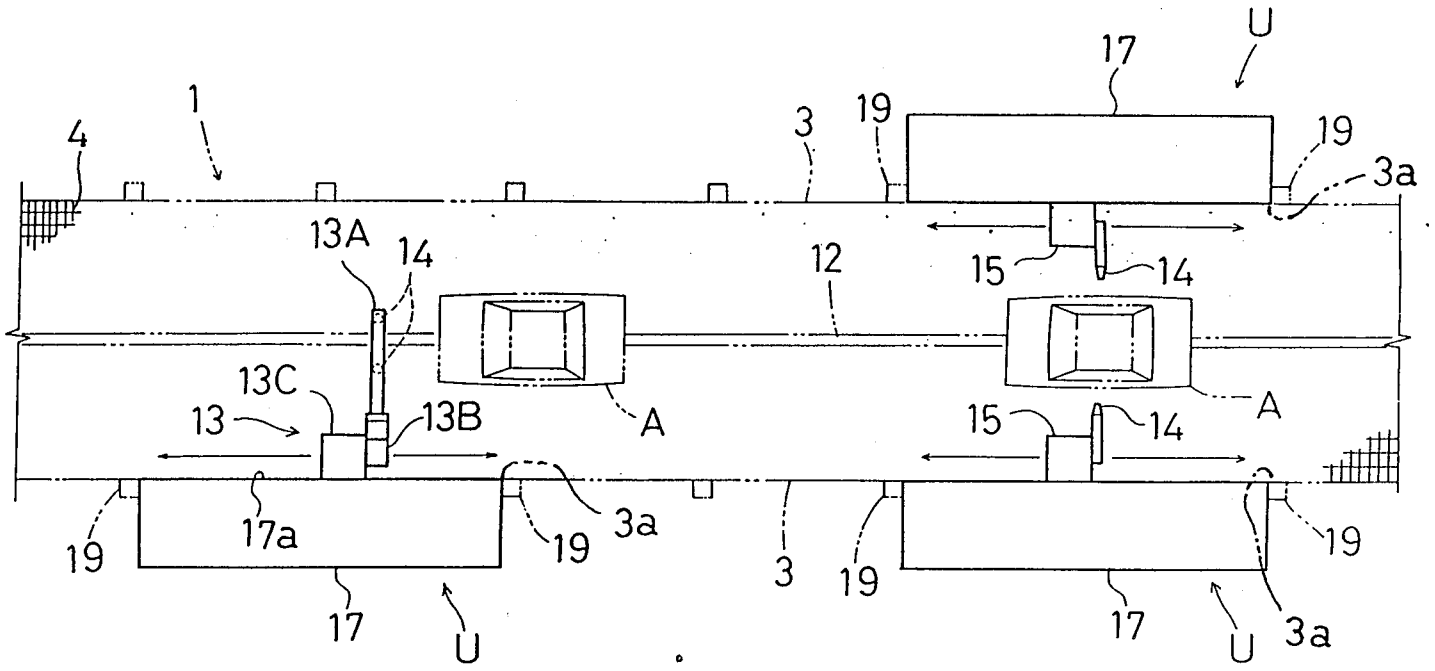

Preferred embodiments of the present invention will be particularly described hereinafter with reference to the accompanying drawings.

First, constructions of a painting booth and a painting-machine control unit will be described with reference to FIGS. 1 through 4.

A painting booth 1 includes a ceiling 2, a side wall 3 and a floor 4 for forming together with a tunnel-shaped painting work area 5. The ceiling defines over substantially entire face thereof an air discharge opening with a filter 2*a* for discharging a ventilation air downwardly therethrough. The floor 4 has its substantially entire face formed of a grating member as an air exhaust opening for exhausting the air at the work area together with excess sprayed paint mist. Numeral 6 denotes a cleaning device for trapping and eliminating the excess paint mist from the air exhausted through the floor 4. This paint-eliminated air is exhausted externally of the booth via an exhaust air passage 7 and an air exhaust fan 8. On the other hand, numeral 9 denotes an air feed fan for feeding the ventilation air conditioned by an air conditioner 10 to a ceiling air feed chamber 11. On the floor 4, there is provided a conveyor 12 for conveying a paint-target object (a body of an automobile in this embodiment) inside the booth. Then, the paint-target object undergoes an automatic spray painting operation by means of an automatic painting machine 13 to be described next, while being conveyed on the conveyor 12.

The painting-machine control unit 10 includes a box type housing 17 having a separate wall portion 17*a* for forming the side wall 3, the painting machine 13 and a control unit C having an operation control panel 18 for operating the painting machine 13.

The automatic painting machine 13 effects a spray painting operation by means of a pair of electrostatic spray guns 14 thereof. These spray guns 14 are attached to a first movable portion 13A formed as a letter 'L'-shaped arm, whereas a second movable portion 13B supports the first movable portion 13A such that the portion 13A may move along the transverse direction of the booth and also pivot about an axis Q positioned at the leading ends of the spray guns 14. Further, the second movable portion 13B is supported on a base portion 13C to be vertically liftable relative thereto. This base portion 13C is movable in the object conveying direction relative to the painting booth 1 and is formed continuously with a housing 17 so as to move along a wall portion 17*a* as being suspended from the same. At a lower end of the base portion 13C, there is provided an engaging portion 31 equipped with a roller 31*a* for preventing vibrations of the base portion 13C through its engagement with a guide rail 30. Since the wall portion 17*a* is formed as an integral part of the box type housing 17, this wall portion 17*a* is physically reinforced for more reliably supporting the painting machine 13.

Numeral 24 denotes a first operation coupler including electric cables, paint pipes, compressed air pipes or the like in e.g. a bundled state for operative connections between the housing 17 and the automatic painting machine 13. This first operation coupler 24 is accommodated in a crawler type mechanism 25 so as to permit the movement of the base portion 13C of the automatic painting machine. Similar mechanisms 26 and 27 are provided also to the second movable portion 13B accommodating a move-drive mechanism 28 for the first movable portion 13A and to the base portion 13C accommodating a lift-drive mechanism 29 for the second movable portion 13B.

Then, by the movement of the base portion 13C and the lifting motion of the second movable portion 13B, the automatic spraying machine 13 effects an automatic spray painting operation on the conveyed target object A while the horizontally-oriented axis Q being positioned over the target surface of the object A and maintaining the spray guns 14 at a predetermined distance from the object surface. Further, with a pivotal drive of the first movable portion 13A, the spray guns 14 are pivoted about the axis Q to have their spraying directions positioned normal to the object surface, whereby the spraying areas of the guns 14 may cover the entire width of the target object A. With these operations, as the object A is conveyed on the conveyor 12, the object has its front, upper and rear faces automatically spray-painted.

The interior of the housing 17 is divided into upper, middle and lower sections. An operator's chamber 16 disposed in the middle section accommodates an operation control panel 18 and a high-voltage generator 23 for the electrostatic painting operation. A wall portion 17*a* in the middle section of the housing 17 includes a monitor window formed of a transparent plate such as of polypropylene for monitoring the inside of the booth. The upper housing section includes a move-drive mechanism 20 for moving the base portion 13C of the painting machine 13 along the wall portion 17*a* of the housing 17 (i.e. the object-conveying direction in the booth). The lower housing section accommodates an electric control panel 21 for the painting machine 13, an air pressure control panel 22 for the spray guns 14, and so on.

A ceiling frame 16*a* and a floor frame 16*b* of the operator's chamber 16 inside the housing 17 respectively define air feed openings 41, such that a portion of the ventilation air is introduced from a duct 40 communicating with the ceiling air feed chamber 11 into the operator's chamber 16 through the air feed opening of the ceiling frame 16*a* and is exhausted therefrom through an air exhaust grating 42 defined in a back face of this housing 17. Further, a dumper 43 disposed inside the duct 40 adjusts the amount of ventilation air from the ceiling air feed chamber 11 so as to increase the atmospheric pressure inside the housing 17, thereby effectively separating an operator and the control unit C inside the chamber 16 from the atmosphere containing excess paint mist and solution gas.

In a painting-machine control unit U including the control unit C and the wall portion 17*a* of the housing (i.e. a portion forming a part of the side wall 3 of the painting booth 1), this wall portion 17*a* and casings for the respective portions 13A, 13B and 13C of the painting machine 13 are formed by affixing polypropylene plate elements to skeltons, thereby to prevent or restrict adhesive accumulation of the excess paint mist charged through the electrostatic painting to these wall portions and casings.

Next, a method of installing the above-described painting-machine control unit U to the painting booth 1 will be particularly described.

The following assembling or checking steps (a) through (d) are carried out in advance at a manufacturing site independently of installment of the painting booth 1.

Step (a)

First, the housing 17 is assembled, in which the monitor window 32, the duct 40 and connecting elements for the side wall 3 of the painting booth 1 are also attached to the housing 17.

Step (b)

The control unit C is installed at the wall portion 17*a* of the housing 17, the floor frame 16*a* of the housing 17 and the floor of the housing 17 to form the floor of the painting booth. More specifically, the operation control panel 18 for the painting machine 13 is incorporated in the operator's chamber 16, and the base-portion move-drive mechanism 20, electric control panel 21, air pressure control panel 22, the high-voltage generator 23 and so on are incorporated into the housing, thereby assemblying the painting-machine control unit U.

Step (c)

To thus-assembled painting-machine control unit U, the base portion 13C of the painting machine 13 is attached, thereby attaching the unit U to the machine 13.

Step (d)

The various control devices are interconnected via a second operation coupler and the first operation coupler such as the electric cables, paint pipes, compressed air pipes and so on to be extended between the housing 17 and the painting machine 13 are also interconnected, thereby setting the control unit U ready for operations of the painting machine 13. Thereafter, at the same site, the test operations of the control unit C, first and second operation couplers and the painting machine 13 are carried out and also checks and adjustments, if necessary, of the painting machine 13 are carried out before the shipment of the unit U. In these operations, even if actual paint is used in the same, the operator is effectively protected against harmful agents such as thinner contained in the paint by means of the housing 17 and no special protecting means is necessary. Further, the operator may readily assess the test operation conditions of the painting machine 13 through the monitor window 32.

Step (e)

This painting-machine control unit U having its operations checked and adjusted is shipped as it is pre-assembled with the machine 13 from the factory to the installation site of the painting booth 1 to be assembled with the same. As described hereinbefore, the first operation coupler 24 such as the paint transport pipes extending from the machine 13 is disposed through the wall portion 17*a*. Accordingly, if the unit U is shipped to the booth installed site with being attached with the first operation coupler 24, the wall portion 17*a* protects this first operation coupler 24 from damage in the course of the shipment.

For installing the painting-machine control unit U, while painting machine 13 is placed at the painting work area 5 inside the booth 1, the wall portion 17*a* of the housing 17 is engaged into the connecting opening 3*a* defined in the side wall 3 of the painting booth 1, and a connecting portion provided at a peripheral edge of the opening 3*a* of the booth 1 and the connecting elements provided at the wall portion 17*a* of the unit U are fixedly connected with each other by means of such connecting means as welding and bolts. Through this step, the operator's chamber 16 incorporating the control panel 18 and the automatic painting machine 13 may be assembled at one time. Further, after the assembly, the wall portion 17*a* of the unit U may be advantageously reinforced by the box type housing 17. Incidentally, in order to reinforce the support of the painting-machine control unit U, there are provided in advance reinforcing pole members 19 at the opposed sides of the connecting opening 3*a*.

After completion of the above-described assembly/installment of the painting-machine control unit U, further connecting operations between the unit U and external devices such as the power source, paint feed devices, compressed air feed device and so on are carried out. An extention coupler member 33 comprises cables and pipes such as electric cables, compressed air pipes for connecting the external devices with the housing 17.

Incidentally, separately from the automatic paying machine 13, automatic side spraying machines 15 for spraying paint on the sides of the object A are disposed at the opposed sides of the painting booth 1 at the upstream and downstream of the object-conveying direction. And, these side spraying machines 15 are installed to the booth 1 through the same unit construction as that of the machine 15.

Some alternate embodiments of the invention will be specifically described next.

(1) When the painting-machine control unit U is shipped to a painting site, the same may be disconnected from the painting machine 13 entirely, or may be disconnected only from the first movable portion 13A and the spray guns 14. Further, all or part of the connections of the first operation coupler may remain open at the time of shipment and be effected again at the time of assembly with the painting booth 1. In this case, since the shipment takes place with keeping the first operation coupler 24 such as pipes and cables attached to the painting-machine control unit U, the possibility of erroneous connecting or extending operations of the pipes and cables or accidental loss of the same may be significantly reduced and so is the installation time at the painting site.

Figure 5:
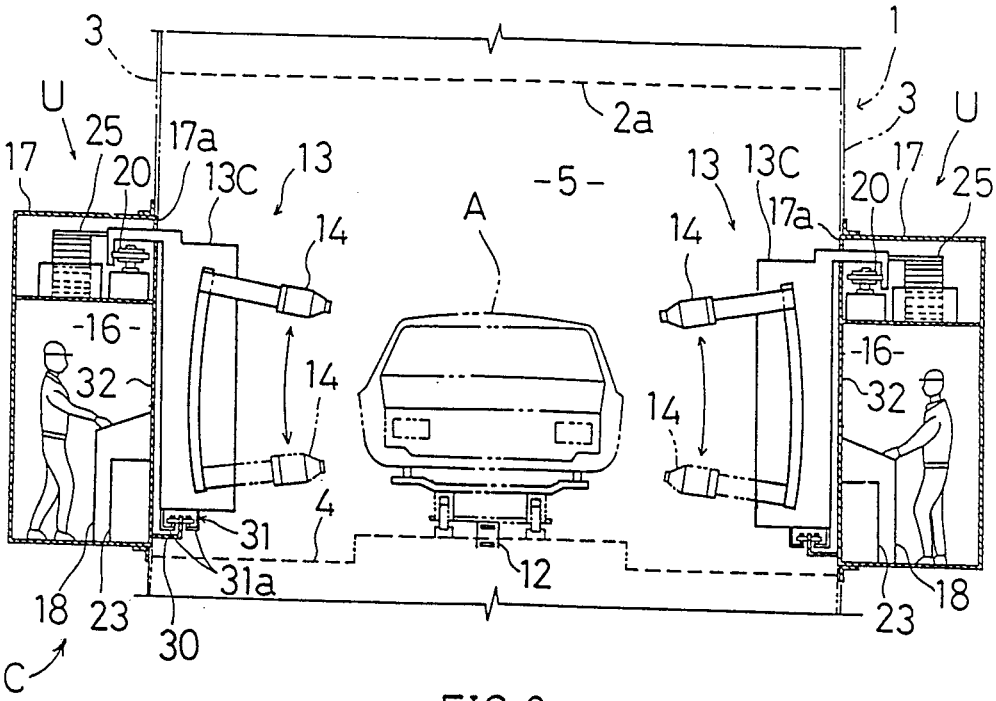
FIGS. 5 through 8 are section views and perspective views showing alternate embodiments.
Figure 6:
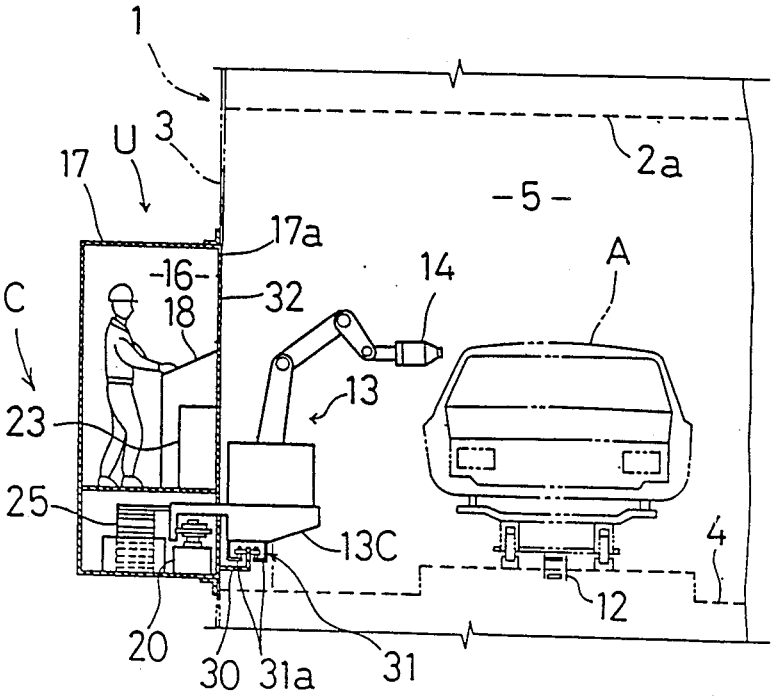

(2) As shown in FIG. 5, the painting-machine control unit U may be alternately equipped with an automatic painting machine 13 for spray-painting the object A with vertical movements of horizontally-oriented spray guns 14 (corresponding to the automatic side spraying machine 15 of the previous embodiment). Or, as shown in FIG. 6, the unit U may be equipped with a one-hand robbot type automatic painting machine 13 having a spray gun 14 at a leading end of the arm. That is, the type of the automatic painting machine to be equipped to the painting-machine control unit U may vary conveniently. Incidentally, reference numeral 20 in FIG. 6 denotes a move-drive mechanism for moving a base portion 13C of the one-hand robbot type painting machine 13 along the object-conveying direction.

Figure 7:
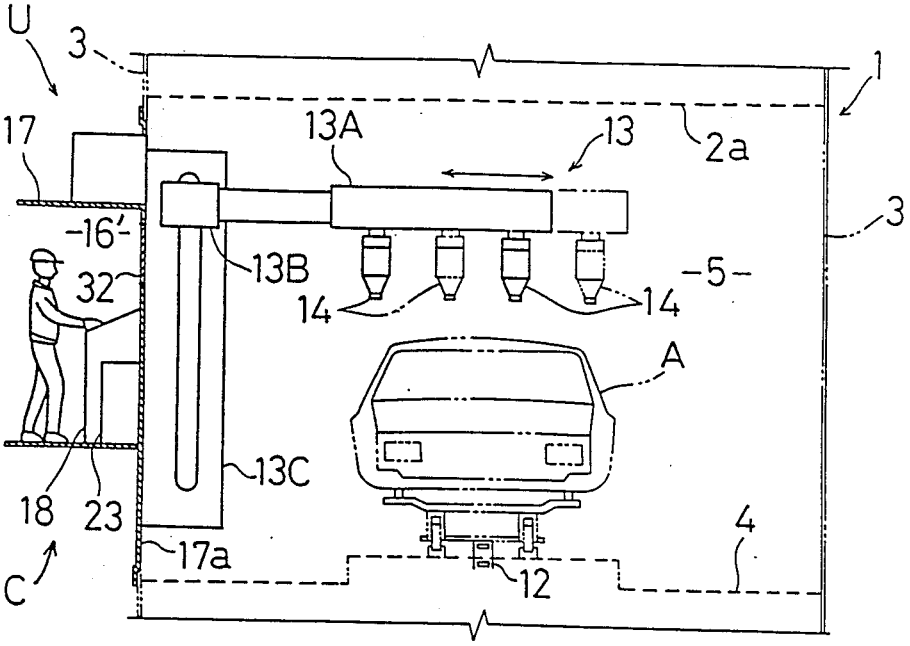
Figure 9:
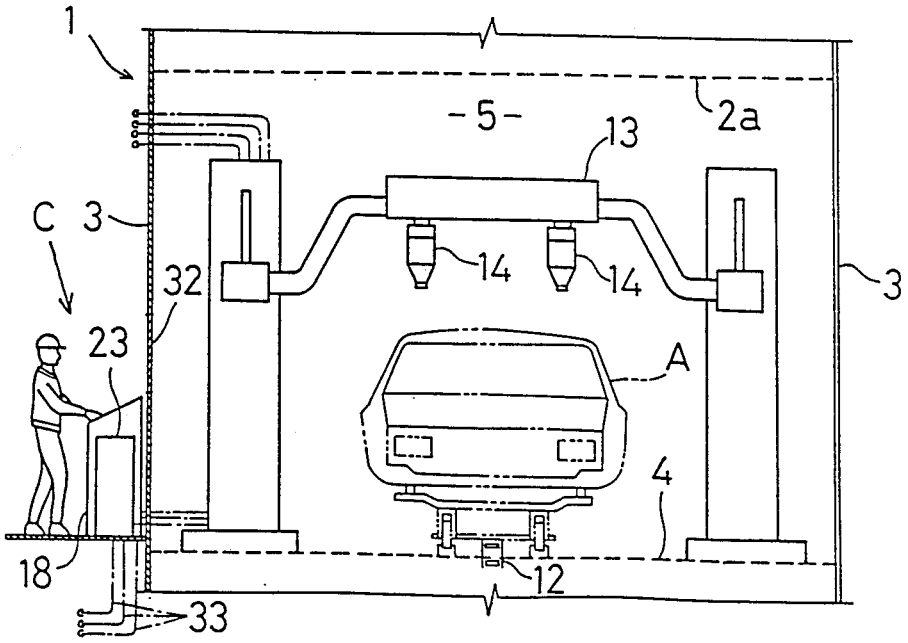
FIG.9 (PRIOR ART)
FIG. 9 is a section view showing the prior art.

(3) As shown in FIG. 7, the base portion 13C of the painting machine 13 may be fixed secured to the wall portion **17*a*** so as to fix the same in the horizontal direction. In this way, the specific attaching construction of the automatic painting machine for the painting-machine control unit U may be modified for improvement conveniently.

(4) In the painting-machine control unit U, if a chamber is to be formed at a side opposed to the disposing side of the spray guns 14 of the machine 13 relative to the wall portion **17*a* forming the part of the side wall 3 of the painting booth 1**, this chamber may be formed as one integral chamber or as a plurality of separate sections.

Further, instead of such chamber, an open work area 16' such as illustrated in FIG. 7 may be formed.

Figure 8:
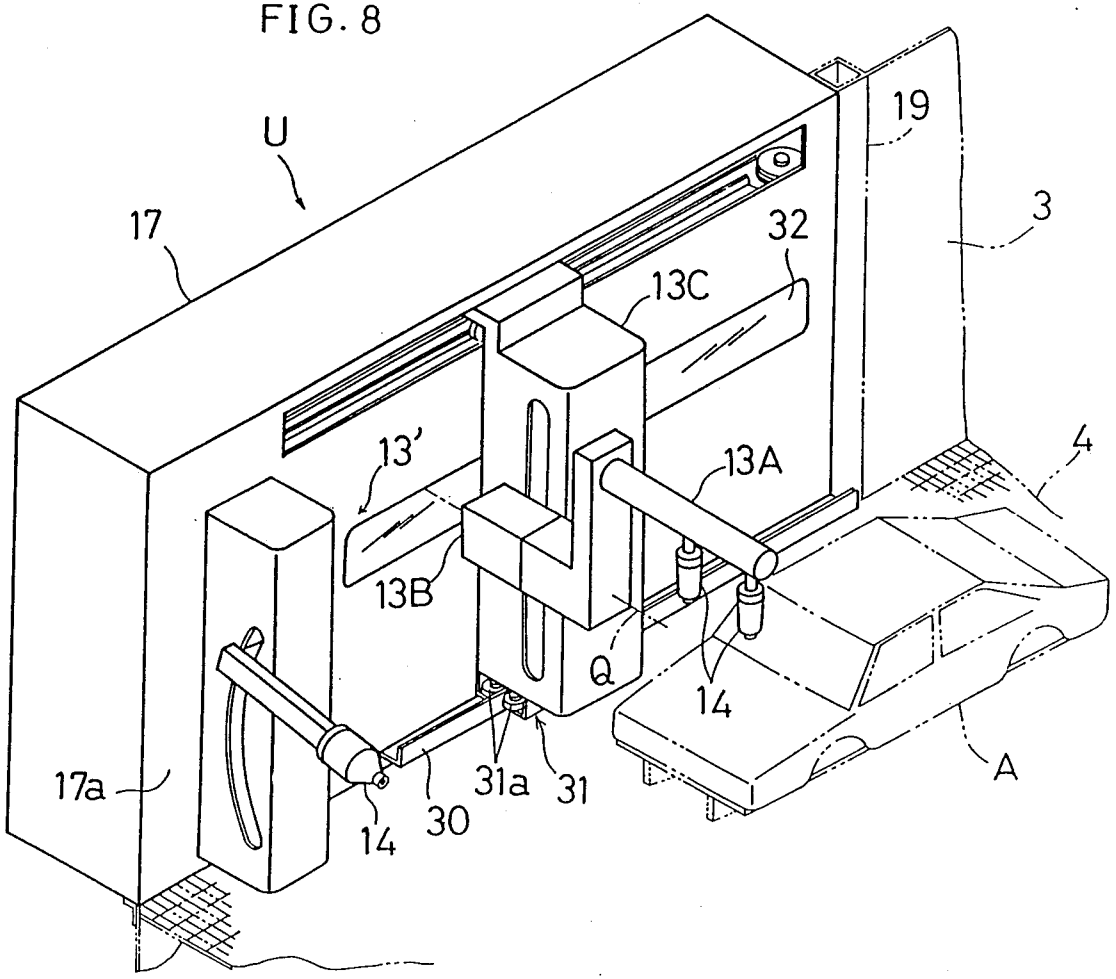

(5) As illustrated in FIG. 8, a singe painting-machine control unit U may be equipped with a plurality of automatic painting machines 13, 13'.

(6) The paint-target object is not limited to the automobile body described in the embodiment but may comprise any other object such as casing for an electric appliance for domestic use.

What is claimed is:

1. A painting machine unit comprising:

a painting booth having a side wall with a substantially vertical wall portion insertable in an opening in said booth side wall and having a viewing window therethrough;

a painting machine attached to an inner side of said wall portion and having means for automatic painting of objects within said booth; and a control unit having means for controlling the means for automatic painting of objects within said booth, said control unit attached to an outer side of said wall portion and surrounded by a control chamber housing for accommodating painting booth operators.

2. A painting machine and control unit combination connected to a painting booth comprising:

said painting booth having a side wall with a substantially vertical wall portion insertable in an opening in said booth side wall and having a viewing window therethrough;

said painting machine attached to an inner side of said wall portion and having means for automatic painting of objects within said booth; and said control unit having means for controlling the means for automatic painting of objects within said booth, said control unit attached to an outer side of said wall portion and disposed within a control chamber housing for accommodating painting booth operators.

3. A painting machine and control unit combination connected to a painting booth as claimed in claim 2, wherein said painting booth includes air feed means for ventilating a painting work area inside said booth, said painting machine and control unit further comprising a duct connectable for communicating between said control chamber and said air feed means.

4. A painting machine and control unit combination connected to a painting booth as claimed in claim 2, wherein said control unit and said painting machine being operatively connected with each other through a first operation coupler.

5. A painting machine and control unit combination connected to a painting booth as claimed in claim 4, wherein said painting booth includes air feed means for ventilating a painting work area inside said booth, said painting machine and control unit further comprising a duct connectable for communicating between said control chamber and said air feed means.

6. A painting machine and control unit combination connected to a painting booth as defined in any one of claims 1, 2, 3, 4 or 5, wherein said painting machine includes a drive device horizontally movable along said wall portion.

7. A painting machine and control unit for attaching to a sidewall of a painting booth, said painting machine having means for automatically painting a target object inside the painting booth;

a substantially vertical wall portion attachable to an opening defined in said side wall and having a viewing window, said painting machine being attached to an inner side of said wall portion; and a control unit for controlling the painting machine, said control unit attached to an outer side of said wall portion and surrounded by a control chamber housing for accommodating painting booth operators.

8. A painting machine and control unit for attaching to a sidewall of a painting booth, said painting machine having means for automatically painting a target object inside the painting booth;

a substantially vertical wall portion attachable to an opening defined in said side wall and having a viewing window, said painting machine being attached to an inner side of said wall portion; and a control unit for controlling said painting machine, said control unit attached to an outer side of said wall portion and disposed within a control chamber housing for accommodating painting booth operators.

9. A painting machine control unit as claimed in claim 8, wherein said painting booth includes air feed means for ventilating a painting work area inside said booth, said painting machine and control unit further comprising a duct connectable for communicating between said control chamber and said air feed means.

10. A painting machine control unit as claimed in claim 8, wherein said control unit and said painting machine being operatively connected with each other through a first operation coupler.

11. A painting machine control unit as claimed in claim 10, wherein the painting booth includes air feed means for ventilating a painting work area inside the booth, said painting machine and control unit further comprising a duct connectable for communicating between said control chamber and said air feed means.

12. A painting machine control unit as claimed in any one of claims 7, 8, 9, 10, 11, wherein said painting machine includes a drive device horizontally movable along said wall portion.

* * * * *